United States Patent [19]

Herubel

[11] 4,193,170

[45] Mar. 18, 1980

[54] DRAWING DEVICE FOR SLIVER

[75] Inventor: Jean F. Herubel, Guebwiller, France

[73] Assignee: N. Schlumberger & Cie, Guebwiller, France

[21] Appl. No.: 883,793

[22] Filed: Mar. 6, 1978

Related U.S. Application Data

[62] Division of Ser. No. 734,969, Oct. 22, 1976, Pat. No. 4,107,821.

[30] Foreign Application Priority Data

Oct. 28, 1975 [FR] France ..... 75 32864
Jul. 15, 1976 [FR] France ..... 76 21611

[51] Int. Cl.[2] ..... D01G 19/10
[52] U.S. Cl. ..... 19/127
[58] Field of Search ..... 19/97, 113, 127, 128, 19/129 R, 236

[56] References Cited

U.S. PATENT DOCUMENTS

| | | | |
|---|---|---|---|
| 2,754,548 | 7/1956 | Heitmuller et al. | 19/127 |
| 2,946,097 | 7/1960 | Hoppner et al. | 19/127 |
| 3,636,591 | 1/1972 | Herubel | 19/236 |

FOREIGN PATENT DOCUMENTS

| | | | |
|---|---|---|---|
| 920717 | 9/1956 | Fed. Rep. of Germany | 19/127 |
| 674 | of 1852 | United Kingdom | 19/129 R |
| 1148830 | 4/1969 | United Kingdom | 19/127 |
| 1205559 | 9/1970 | United Kingdom | 19/129 R |

*Primary Examiner*—Werner H. Schroeder
*Attorney, Agent, or Firm*—Toren, McGeady and Stanger

[57] ABSTRACT

In a drawing device for sliver comprising two endless moving elements having cooperating working runs between which the sliver passes, at least one of the elements is constituted by a plurality of bars extending between a pair of parallel carriers (e.g. chains) and each bar has a convexly curved outer working surface from which penetration members, (e.g. needles) extend.

4 Claims, 9 Drawing Figures

DRAWING DEVICE FOR SLIVER

This is a division of Application Ser. No. 734,969 filed Oct. 22, 1976 now U.S. Pat. No. 4,107,821.

FIELD OF THE INVENTION

This invention relates to a drawing device for sliver.

In such a device, sliver passes between two endless moving elements which control and retain the fibres whilst they are drawn by drawing cylinders downstream of the device.

DESCRIPTION OF THE PRIOR ART

A known such device comprises two sets of high population needles which penetrate the sliver and constitute retention members.

This device has the disadvantage of high cost and limited speed. The latter is due to the mode of propulsion which is by means of a screw and to the limited strength of the welds connecting the needles to their support. The limited speed means limited sliver processing.

An object of the invention is to obviate these disadvantages by providing a simple drawing device which allows good control of the sliver, which is of a relatively low cost and which makes high speed working possible.

BRIEF DESCRIPTION OF THE INVENTION

The invention provides a device for drawing sliver, comprising, for the control and the retention of the sliver, two endless moving elements between which the sliver passes, one of which, at least, is constituted by an assembly of transverse bars mounted between two endless chains for movement on a closed circuit, the hinged transverse bars carrying member for penetration into the sliver, having a convex cylindrical active surface for contact with the sliver, and forming a materially continuous apron in the working zone.

In a preferred embodiment the two endless elements have the same structure, the members for penetration into the ribbon being staggered from one element to the other in the working zone.

In another embodiment, only one of the endless elements is arranged as described above and the other has any practical suitable structure. This can, for example, be a smooth apron having depressions for the passage of the members carried by the first element and smooth raised surfaces cooperating with the convex surface of the needle-carrying elements in order to control the ribbon.

In accordance with another embodiment, the bodies of the element which carries penetration members are provided only with a single row of members. This row can be disposed in the middle of the body, or be off-set with regard to the centre, that is to say be located in a plane parallel to the median longitudinal plane of the body. With regard to the direction of advance of the material, this single row can be located before or after the median longitudinal plane.

In accordance with one feature of the invention, the bodies of the element which carries penetration members have a circular cylindrical convex surface which, upon passage of the bars over a pair of return wheels guiding the endless element at the exit from the drawing zone, is coaxial to the said wheels so that the penetration members leave the sliver with the minimum of relative speed and create a disturbance of the sliver which is as small as possible.

In accordance with another feature, one of the two pairs of return wheels, at the exit from the drawing zone, is set back relative to the other pair so that that of the two drawing cylinders which has the largest diameter can be brought nearer to the said other pair, so that the distance which the sliver covers between the end of the control zone and the drawing cyclinders is as small as possible.

In accordance with another feature, usable in the first preferred embodiment of the invention, the feed cylinders, arranged upstream of the control zone, are placed so that the sliver co-operates first with one of the endless elements and then with the other, to create a progressive entry of the two sets of penetration members into the sliver.

In accordance with another feature of the invention, all the penetration members, or only a part thereof, can be inclined relative to the median longitudinal plane of the bodies, towards the front or towards the rear relative to the direction of circulation of the bars.

In accordance with another feature of the invention, the bodies of the element which carries penetration members are contiguous, that is to say that, in the working zone, and preferably only in this zone, they are very close to one another in order to form a practically continuous apron not allowing fibres, fluff or other waste to penetrate into the mechanical part of the machine or even onto the elements which are underneath, on their return path.

In another embodiment of the invention, the drawing device is characterised by the combination, on the one hand, of a control field equipped with an endless element having a succession of hinged transverse bars carrying small population penetration members and having a convex cylindrical active surface, with, on the other hand, a control field equipped with an endless element having a succession of transverse strips having a flexible lip for contact with the sliver which they apply to the convex surface of the bars carrying the penetration members.

BRIEF DESCRIPTION OF THE DRAWINGS

The invention will be described further, by way of example, with reference to the accompanying drawings, wherein.

DESCRIPTION OF PREFERRED EMBODIMENTS

Figure 1:
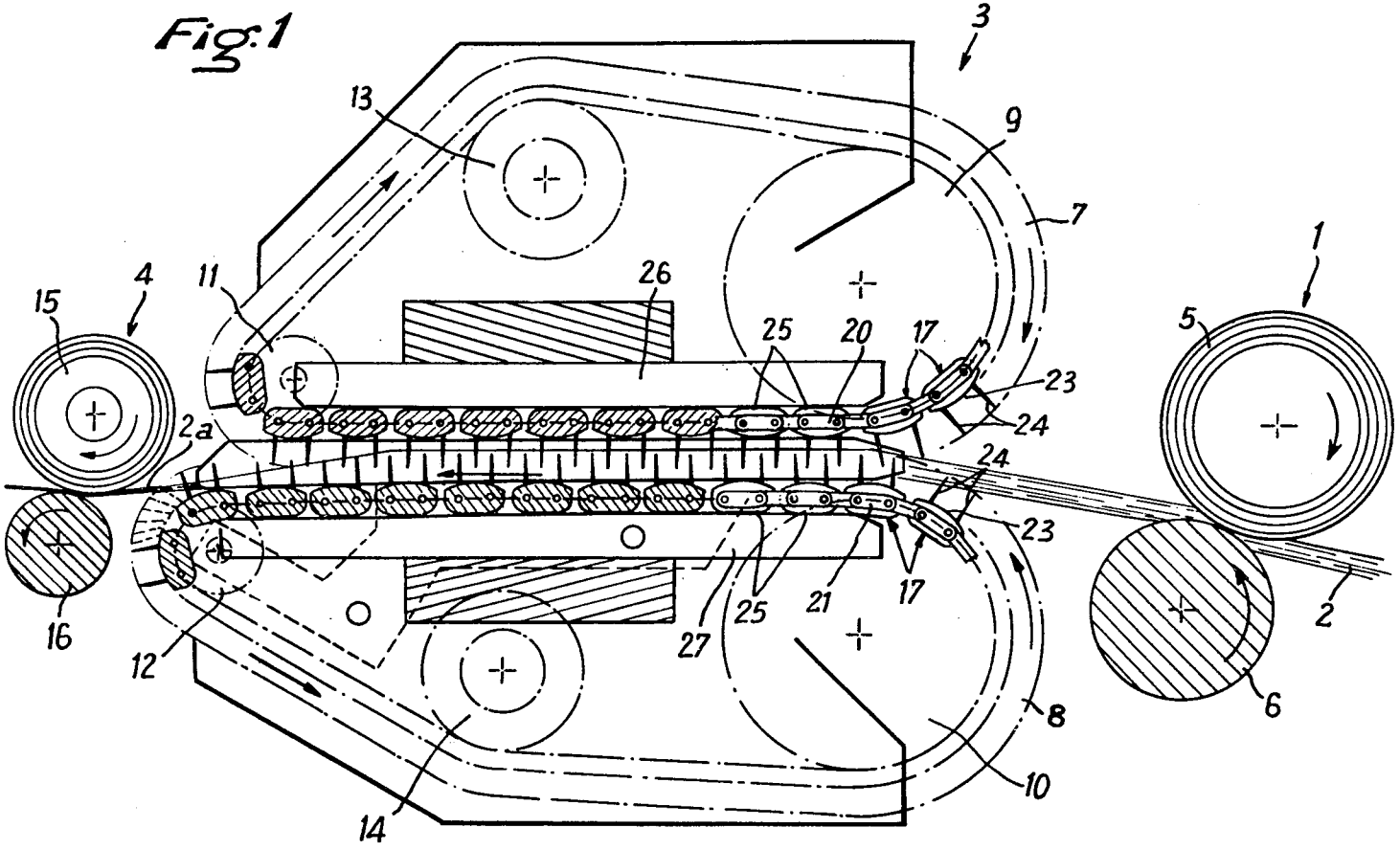
FIG. 1 is a schematic side view, with section and with parts broken away, of a drawing device in accordance with a preferred embodiment of the invention.

The drawing device shown in FIG. 1 comprises a feed station 1 for feeding in sliver 2, a control station 3 for retention of the sliver, and a drawing station 4.

The feed station 1 comprises, in known manner, two cylinders 5, 6 between which the sliver 2 passes and which is delivered thereby at a desired speed.

The control and retention station 3 comprises, also in a known manner, two endless elements 7, 8 situated one above the other and circulating around pairs of driving inlet wheels 9, 10, pairs of return outlet wheels 11, 12 and pairs of detour wheels 13, 14 for the return runs. Between the pairs of inlet wheels 9, 10 and outlet wheels 11, 12, the active runs of the endless elements 7, 8 are parallel and circulate jointly in the same direction and at the same linear speed.

The drawing station 4 comprises, also in a known manner, an upper cylinder 15 and a lower cylinder 16 of smaller diameter, which attract the sliver 2 controlled and partially retained by the elements 7, 8.

Figure 3:
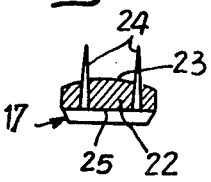
FIG. 3 is a cross section of the bar of FIG. 2.

In accordance with the invention, more especially to ensure a good control of the sliver, at least one of the elements 7, 8 is constituted by a succession of transverse bars 17, hinged one to the other, carrying members of low population for penetration into the sliver and having a convex cylindrical active surface for contact with the sliver. The convex surface has a crown portion which is closest to the other element as the elements pass in facing relation through the control station 3. In FIG. 3 the crown portion is symmetrically located between the edges of the transverse bar.

Figure 2:
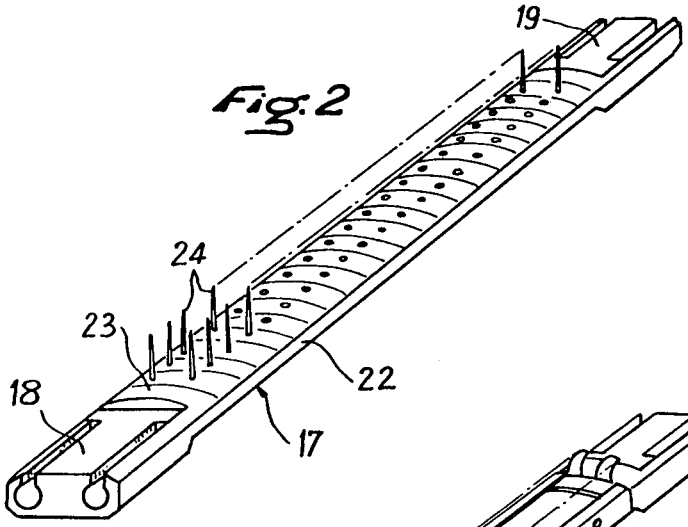
FIG. 2 is a perspective view of a convex needle bar of the device of FIG. 1.

In accordance with the embodiment shown in FIGS. 1 to 3, the bars 17 are each in the form of the block comprising ends 18, 19 for the hinged coupling to lateral chains 20, 21 (FIG. 1) and an elongate body 22 having a convex cylindrical active surface 23. Needles 24 are secured to the body 22, in a suitable manner, for example by driving in with force.

The needles 24 are implanted with a low population, in two parallel rows symmetrical relative to the median longitudinal plane of the bodies 22, that is, the plane through the crown portion of the convex surface. In other words, the needles are spaced from the crown portion of the transverse bars which represents the surfaces of the bars closest together with the work zone. They are, by way of example, arranged perpendicular to the direction of advance of the elements 7, 8 in the rectilinear zone of co-operation of these, but they could also be inclined forwards or backwards. The bars 17 of one of the two elements are off-set relative to those of the other elements, in the direction of advance, so that the rows of needles are spaced apart one from the other by the same distance, in the work zone.

The lateral chains 20, 21 co-operate with the toothed wheels 9 to 14 for driving the bars 17. In the said rectilinear zone, the flat inner surface 25 of the bars 17, remote from the convex outer surface 23, co-operates with upper fixed guides 26 and lower fixed guides 27 which determine the distance between the elements 7, 8 in the said zone.

In operation, the sliver is delivered by the feed cylinders 5, 6 and pulled by the drawing cylinders 15, 16. Between these two pairs of cylinders, the sliver 2 is controlled and retained by the bars 17, in two ways simultaneously; on the one hand, by the needles 24 which penetrate into the structure of the sliver and control it internally and, on the other hand, by the convex surfaces 23 which control it externally.

In the embodiment of FIG. 1, the two elements 7, 8 are of the type having bars with needles 24 and having a convex surface 23; the needles of the bars 17 are off-set from one element to the other, in the zone of co-operation of the said elements.

In accordance with one feature of the invention, the convex surface 23 of each bars 17 is of a circular cross-section and of a radius such that, at the passage of the chains 20, 21 over the outlet wheels 11, 12, the circular contour of the corresponding bars is coaxial to the said wheels; in this way, the outlet movement of the needles from the structure of the sliver at the end of control is effected materially without any relative movement between the needles and the sliver, since the sliver unrolls from the convex surfaces 23, with reduces to its minimum the displacement of the fibres created by the exit of the needles.

In accordance with another feature of the invention, the pair of upper return wheels 11 is set back relative to the pair of lower wheels 12, so that the upper drawing cylinder 15, of a larger diameter than the lower drawing cylinder 16, can occupy a position very close to the lower endless element 8; in this way, as is shown in FIG. 1, the distance which the drawn sliver 2*a* covers between the end of the control zone and the drawing cylinders is very short.

In accordance with another feature of the invention, the feed cylinders 5, 6 are so positioned that the sliver 2 cooperates first with the needles 24 of one of the elements 7, 8 for example with those of the lower element 8, then with those of the other element; in this way there is established a progressive entry of the two fields of needles 24 into the sliver 2. Generally, the inlet wheels 9, 10 are situated at the same level; this is why, as is shown in FIG. 1, the feed cylinders 5, 6 are vertically off-set relative to the median horizontal plane of the wheels 9, 10.

Figure 4:
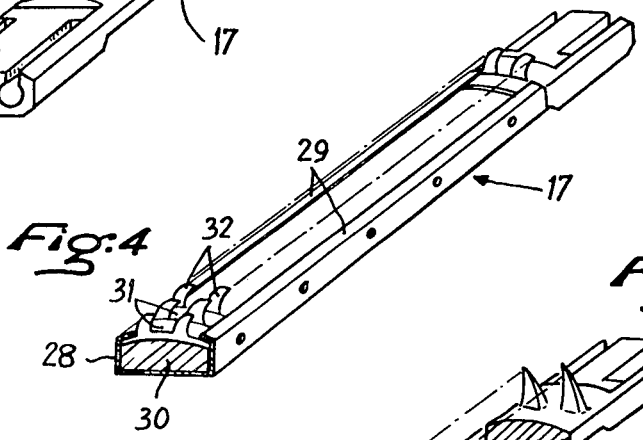
FIGS. 4 and 5 show, in broken-away perspective, two modifications of bar of the device of the invention.
Figure 5:
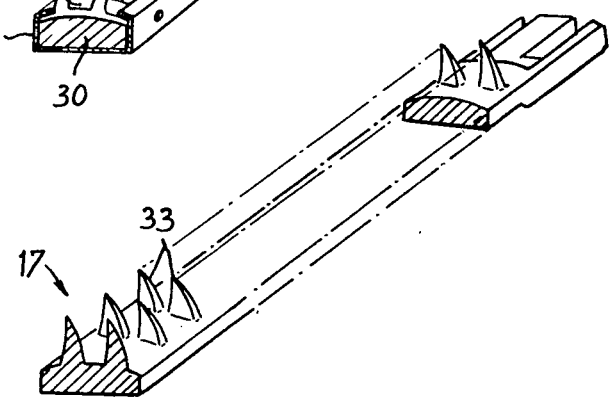

In FIGS. 4 and 5 there have been shown two modifications for the bars 17 which differ from those of FIGS. 1 to 3 only by the structure of their median part. In FIG. 4, the bar 17 comprises, in its median part, a channel 28 having two reentrant upper flanges 29. The interior of the channel is filled with a filling material 30, flexible or rigid, and, under the flanges 29 there are slid convex small plates 31 placed side-by-side and having protruding teeth 32, or the like, of low population.

In FIG. 5, the median part of the bar 17 is in one piece and has integral projections 33, in the form of teeth, needles, blades, etc., of low population.

Figure 6:
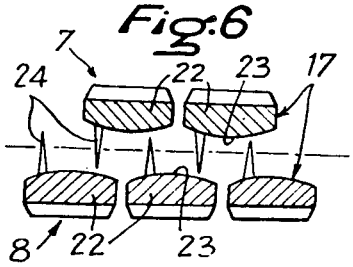
FIG. 6 shows, in cross section, a modification in which the bars of the two endless elements are each equipped with only a single row of needles.

In the modification of FIG. 6, the bars 17 of the endless elements 7, 8 differ from those of FIGS. 1 to 3 only by the presence of a single row of needles 24 on the body 22 of the bars and by the off-setting by half a pitch of the bars of the upper 7 and lower 8 elements, the needles 24 being offset relative to the median longitudinal plane of the body 22.

Figure 7:
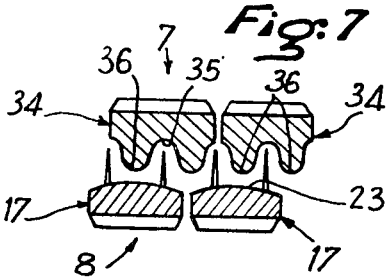
FIG. 7 shows, in cross section, a modification in which the bars of the two endless elements are of a different structure.

As indicated previously, only one of the two endless elements 7, 8, for the control of the sliver, can comprise bars having needles, or the like, and having a convex surface. There is shown in FIG. 7 a part of a device in accordance with the invention having such an arrangement. In this figure, the lower endless element 8 comprises bars 17 having needles, or the like, and having a convex surface, while the upper endless element 7 is of any suitable structure whatsoever. It comprises, for example, bars 34, mounted and hinged like the bars 17, and having, on their active surface, grooves 35 for the passage of the needles of the element 8, and smooth raised portions 36 for co-operating with the convex surface 23 of the bars 17 having needles 24, in the control of the sliver.

In all the embodiments, the bars 17 or 34 of one and the same endless element 7, 8 are very close together, at least in the working zone, to form a materially continuous apron not allowing the fibres, fluff or other waste, to pass into the mechanical part of the machine or onto the return run of the elements 7, 8.

Figure 8:
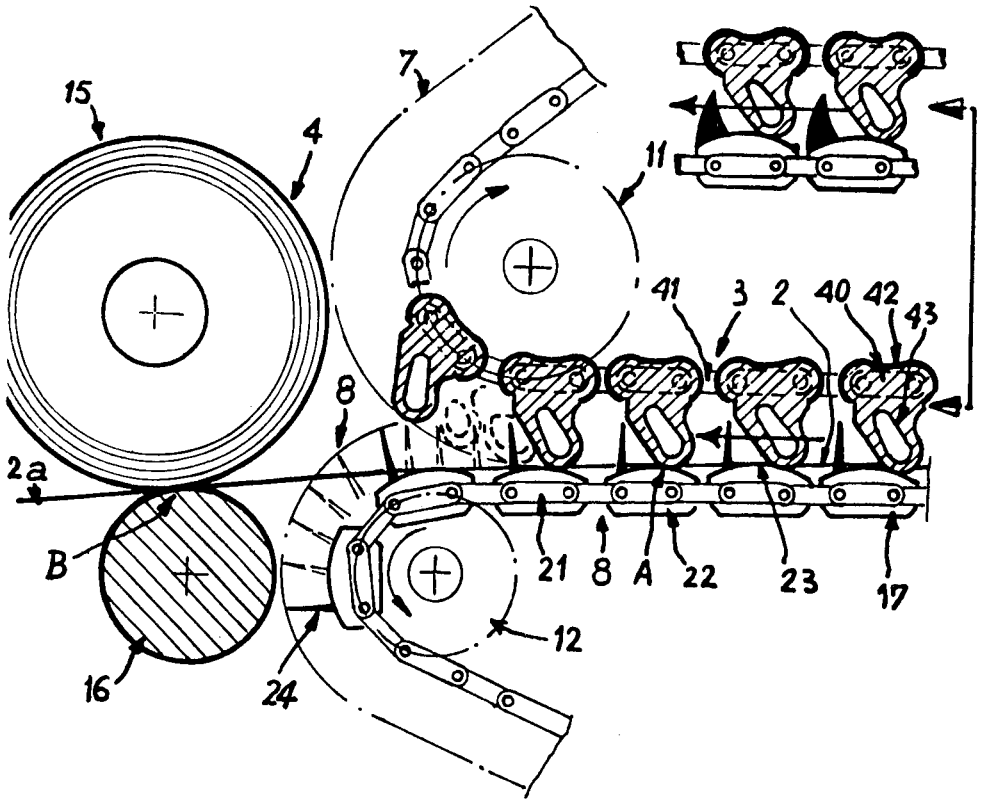
FIG. 8 shows, in side view, the part next to the drawing station, in another modification.
Figure 9:
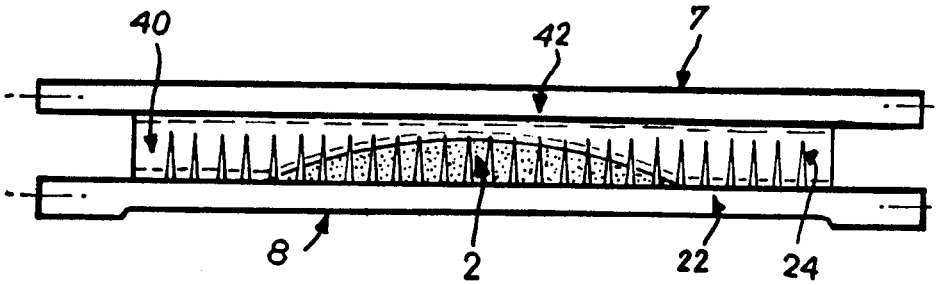
FIG. 9 is a cross section of the control device of FIG. 8 to show how the fibres are maintained and controlled by the penetration members constituted by needles cooperating with contact members constituted by flexible lips.

Finally, in another modification shown partially in FIGS. 8 and 9 (in which there have been retained the same reference numbers as in FIG. 1 for denoting the corresponding members) the feed station has not been shown.

The station 3 for control and retention of the sliver comprises two endless elements 7 and 8 situated one above the other and their active runs circulate jointly in the same direction and at the same linear speed.

The lower field 8 comprises the transverse bars 17 hinged one to the other and fixed, at each of their ends, to a chain 21 driven by a toothed wheel 12. The bodies 22 of the bars 17 have a convex cylindrical active surface 23 and comprise only a low population of members for penetration into the sliver, namely a single row of needles 24 arranged, in the example shown, perpendicular to the direction of advance of the element 7 in the rectilinear portion of the active run of the chain, and, offset laterally, in the direction of advance, relative to the vertical plane of symmetry or crown portion of the convex surface of the bar 17. The needles 24 could moreover be inclined forwards or backwards.

The upper field 7 comprises transverse strips 40 having a flexible lip, of a kind known from French Pat. No. 1,593,755 of the assignee firm, which are made of a resilient material such as rubber, elastomer or leather, fixed at each end on a chain 41 driven by a toothed wheel 11.

Each of the transverse strips 40 is engaged, in its mounting portion, in the curved edges of a metallic part 42 in the form of a channel 42 while, in its working portion, it is, preferably, hollowed out at 43 to facilitate the suppleness of the movements of the lip; this latter is inclined backwards, relative to the direction of circulation, to provide, on its contact with the convex bar 17, a jamming or interference effect. The strips 40 and the bars 17 are arranged so that the needles 24 of a bar place themselves into the gaps between the flexible lips of two consecutive strips 40. Thus, the sliver 2, coming from the food cylinders (not shown), is supported and controlled by the lower endless element 8 and the upper endless element 7 in order to be drawn by the drawing cylinders 15, 16 and to emerge as a drawn sliver 2*a*.

It can easily be seen that, thanks to such a combination of means, the fibres are well held and controlled by the interacting action of the convex bars 17 having needles 24 and of the flexible lips 40, and wall parallelised and in more regular bunches through the effect of the needles. Up to the point A, the last line of strong pinching between the fields 7 and 8 before the drawing cylinders 15 and 16, the fibres are well held, and it is only between the points A and B (B being the line of nip of the said drawing cylinders) that the drawing process takes place.

In FIG. 9 there has been shown the configuration which is assumed by a strip 40 having a flexible lip which exerts on the sheet of fibres 2 being treated a pressure which is greater, the greater the thickness of the sliver. In the middle of the sliver, that is to say at the point of its maximum thickness, the pressure is also maximum, while, on the edges where the thickness of the sheet is slight, the pressure is much less.

It emerges from the foregoing that the device of the invention, by virtue of the combination of the members having low population for the penetration into the structure of the sliver and of the convex surfaces, ensures a good control of the sliver and can be constructed in an economical manner. Moreover, the device is sturdy and makes possible operation at high speed.

In addition, the connecting parts of slivers pieced before the entry into the device, are well equalised and smoothed thanks to the presence of the needles; on the other hand, thanks to the low population of the needles, one eliminates the risk of catching and of winding of the fibres, and the decrease of control of the fibres by the needles is compensated for by the control by the convex surfaces. Thus, with a device in accordance with the invention, thanks to the double control by needles and convex surfaces, the advantages of the control by needles are preserved and the disadvantages eliminated.

It is understood that the invention is not restricted to the embodiment described and shown and that one can, on the contrary, conceive various modifications without departing from its scope.

Thus the needles 24 can be replaced by knives, blades, teeth or by any other penetration member.

I claim:

1. A device for drawing sliver comprising two endless elements moving in unison and one located above the other and forming therebetween a working zone through which the sliver passes for the control and retention of the sliver, one of said two endless elements comprising an assembly, said assembly comprising a pair of laterally spaced endless chains mounted for movement on a closed circuit with a portion of the circuit traversing the working zone, a plurality of first transverse bars extending between said pair of endless chains and being hinged relative to one another by said endless chains, each of said first transverse bars having a first relatively flat convex active surface facing inwardly toward the other said endless element as said first transverse bars traverse the working zone, said first transverse bars being spaced closely apart so that the first convex active surfaces of said transverse bars form a materially continuous apron in the working zone, the first convex active surfaces of said first transverse bars each having a crown portion located closest to the other said endless element as said first transverse bars traverse said working zone with the crown portion forming a contact surface for the sliver, a plurality of penetration members formed on and projecting outwardly from said first convex active surface toward the other said endless element as said first transverse bars traverse the working zone, said penetration members being offset in the direction of movement of said endless elements through the working zone from the crown portion of said first convex active surface on which they are located, said penetration members arranged in a row extending transversely across said first convex active surface and the other of said two endless elements comprises a succession of second transverse bars hinged to one another and each having a second convex active surface facing toward the one of said two endless elements in said working zone, two successive said second active surfaces in said working zone defining therebetween a space for receiving the row of said penetration members on said first convex surface located opposite the space and said second active surfaces cooperating with the crown portions on said first active surfaces for controlling the sliver, each said second transverse bar comprises an elongated transverse strip which in said working zone faces toward and is spaced from an oppositely disposed one of said first transverse bars, and a flexible lip secured to and extending from each said transverse strip toward the oppositely disposed one of said first transverse bars and the surface of said flexible lip spaced from said transverse strip forms said second convex active surface thereon and said second convex active surface applies the sliver to the first convex active surface of said first transverse bars.

2. The device as claimed in claim 1, wherein said other endless element comprises an assembly including said transverse strips, two endless chains mounted for movement on a closed circuit, elongated transverse channel section parts with the ends of said parts secured to said endless chains of said other endless element, and said transverse strips secured to said transverse channel section parts and said flexible lips projecting outwardly from said transverse channel section parts.

3. The device as claimed in claim 2, wherein said flexible lips on said transverse strips are inclined backwards relative to the direction of movement of said strips through said working zone.

4. The device as claimed in claim 2, wherein said flexible lips each have a hollowed-out interior extending in the elongated direction of said hollow strips and said hallowed-out interior located adjacent said second convex active surface.

* * * * *